United States Patent [19]

Schmid

[11] Patent Number: 4,580,737

[45] Date of Patent: Apr. 8, 1986

[54] MACHINE FOR PRODUCING CROSS-WOUND BOBBINS

[75] Inventor: Reinhold Schmid, Monchen-Gladbach, Fed. Rep. of Germany

[73] Assignee: W. Schafhorst & Co., Moenchengladbach, Fed. Rep. of Germany

[21] Appl. No.: 681,916

[22] Filed: Dec. 14, 1984

[30] Foreign Application Priority Data

Dec. 17, 1983 [DE] Fed. Rep. of Germany ..... 3345743

[51] Int. Cl.[4] ..... B65H 54/20; B65H 54/28

[52] U.S. Cl. ..... 242/35.5 R; 242/43 R; 242/158 R; 308/6 R

[58] Field of Search ..... 242/35.5 R, 43 R, 43.1, 242/158 R, 158.1, 158.5; 308/6 R

[56] References Cited

U.S. PATENT DOCUMENTS

| | | | |
|---|---|---|---|
| 991,329 | 5/1911 | Lane | 308/6 R |
| 1,957,979 | 5/1934 | Richter | 242/43.1 |
| 2,524,623 | 10/1950 | Columbu | 242/35.5 R X |
| 2,763,275 | 9/1956 | Cummings | 308/6 R X |
| 3,161,165 | 12/1964 | Comerio | 308/6 R X |
| 3,407,011 | 10/1968 | Zeidler | 308/6 R |
| 4,419,904 | 12/1983 | Albury | 308/6 R X |

*Primary Examiner*—Stanley N. Gilreath

*Attorney, Agent, or Firm*—Herbert L. Lerner; Laurence A. Greenberg

[57] ABSTRACT

A machine for producing cross-wound bobbins, includes a machine frame, detachable rotary guiding elements supported at fixed locations on the machine frame, a reciprocating rod guided by the rotary guiding elements, the rotary guiding elements being distributed along the length of and about the periphery of the rod, and a plurality of thread guiding elements operating in parallel and being driven in common by the rod.

7 Claims, 6 Drawing Figures

MACHINE FOR PRODUCING CROSS-WOUND BOBBINS

The invention relates to a machine for producing cross-wound bobbins or cheeses having a plurality of thread guiding elements which work in parallel and are driven together by a reciprocating rod which is supported at the machine frame for shuttling back and forth.

For example, the thread guiding elements may be thread guides which move back and forth, or thread deflection elements of a thread storage device or a thread length compensator.

A reciprocating rod of this type is loaded by bending, pressure and tension forces during operation. Heretofore, in order to guide such a reciprocating rod in a straight path, slide bearings were considered to be satisfactory. However, modern machine technology provides such a great number of parallel operating work stations, that the simple, low priced slide bearings lead to unexpected difficulties. In particular, when the direction of motion changes, the friction and inertia forces which are generated are so great that the conventional straight line guides are unsuited for long and slender rods made of a light weight material.

It is accordingly an object of the invention to provide a machine for producing cross-wound bobbins, which overcomes the hereinaforementioned disadvantages of the heretofore-known devices of this general type, and which provides reliable thread guidance for long cross-wound bobbin production machines in a simple manner with alternating thread guiding elements which can be easily assembled. With the foregoing and other objects in view there is provided, in accordance with the invention, a machine for producing cross-wound bobbins or cheeses, comprising a machine frame, detachable rotary or cylindrical guiding elements supported at fixed locations on the machine frame, a reciprocating lifter rod guided by the rotary guiding elements for moving back and forth, the rotary guiding elements being distributed along the length of and about the periphery of the rod, and a plurality of thread guiding elements operating in parallel and being driven in common by the rod.

Rotary guiding elements have low friction and can be constructed with little mass. Since the rotary guiding elements are distributed about the periphery of the rod as well as along the length of the rod, the mounting and removal of individual rotary guiding elements presents no difficulty at all. The contact of the rod and the adjustment of the guiding elements also presents no problems. The distribution of the contact or bearing points along the length of the reciprocating rod ensures that the rod has some springy play at each guide position, so that there is good contact between the rotary guiding elements and the reciprocating rod, even if the surface of the rod is not perfectly uniform. This is the case with rods made of a rigid plastic material and therefore rods made of these materials are especially well suited for use in the machine for producing cross-wound bobbins. Due to the distribution of the rotary guiding elements, the rod is not continuously loaded in one direction. The direction of load can be changed and distributed, so that the total assembly guarantees a straight linear guide, and the rod cannot move laterally. If the straight motion of the rod is disturbed, it is not necessary to pull the whole reciprocating rod out of the assembly in order to exchange any of the guiding elements.

In accordance with another feature of the invention, the rotary guiding elements are track support or backing rollers supporting the rod. The guiding elements may be supported in sleeve or slide bearings. This construction is especially simple and reliable. The support rollers may have cylindrical outer surfaces. This type of support roller is recommended in general; however, there are exceptions.

In accordance with a further feature of the invention, two of the rotary guiding elements are combined into a common element pair mountable against the outside of the rod. This feature provides not only assembly and adjustment advantages, but also makes it possible to distribute the transverse forces very uniformly or equally onto the support rollers of the element pair. Thus, element pairs contribute to the stabilization of the support and guidance of the reciprocating rod.

In accordance with an added feature of the invention, each of the rotary guiding elements contacts the rod at least at one support point and at most at two support points along the rod. The abovementioned support roller with a cylindrical outer surface will only touch a round rod at one support point. In contrast, a tracking or support roller can touch the same rod at two support points if the roller has two conical rims.

Although the normal forces exerted by the rod transversely to its motion can be kept rather small, increased wear of the guide regions or support points can be caused by improper positioning and adjusting of the rotary guiding elements.

In order to avoid this, in accordance with an additional feature of the invention, the support rollers have bearings with center points, and the sum of the normal forces exerted by the rod on one of the support rollers transverse to the longitudinal axis of the rod, passes through the center point of the bearing of the one roller. Therefore, it is important to align the rotary guiding elements or the element pairs carefully with respect to the reciprocating rod, in order to avoid unnecessary friction or wear.

As mentioned above, cylindrical support rollers are preferred. However, for the initial assembly it is advantageous if, in accordance with again another feature of the invention, at least one of the rotary guiding elements of the element pair is a guiding or tracking roller (a roller with a rim). The element pairs can be mounted first, so that the reciprocating rod is held by the element pairs in its predetermined position. The other rotary guiding elements or element pairs are then placed and fastened at the rod which is already in its normal position, during the assembly.

In accordance with again a further feature of the invention, the rotary guiding elements or rotary guiding elements of the element pair alternately contact the rod from opposite sides thereof.

In accordance with a concomitant feature of the invention, the rotary guiding elements of the element pair are rollers having axes of rotation defining a plane, and the element pair includes a supporting rocker carrying the rollers being pivotable about a horizontal axis disposed outside the plane. The initial assembly operation is in particular greatly facilitated in this way.

Such an arrangement of the rollers enables easy and accurate centering during the initial assembly of the reciprocating rod into the machine, by first attaching two or more element pairs to the machine frame and then inserting the reciprocating rod axially between the element pairs after lifting the rocker. In this way, the reciprocating rod always rests on the lower roller due to its own weight, and therefore tilts the rocker about its pivot axis until the upper roller contacts the top of the rod. In this manner, a good contact of both rollers on the reciprocating rod is assured even during longitudinal movements of a reciprocating rod which is not perfectly straight, or which has a surface which is not quite even. The structure makes it possible to compensate for uneven conditions, and it always adapts itself to the surface condition of the reciprocating rod.

Other features which are considered as characteristic for the invention are set forth in the appended claims.

Although the invention is illustrated and described herein as embodied in a machine for producing cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
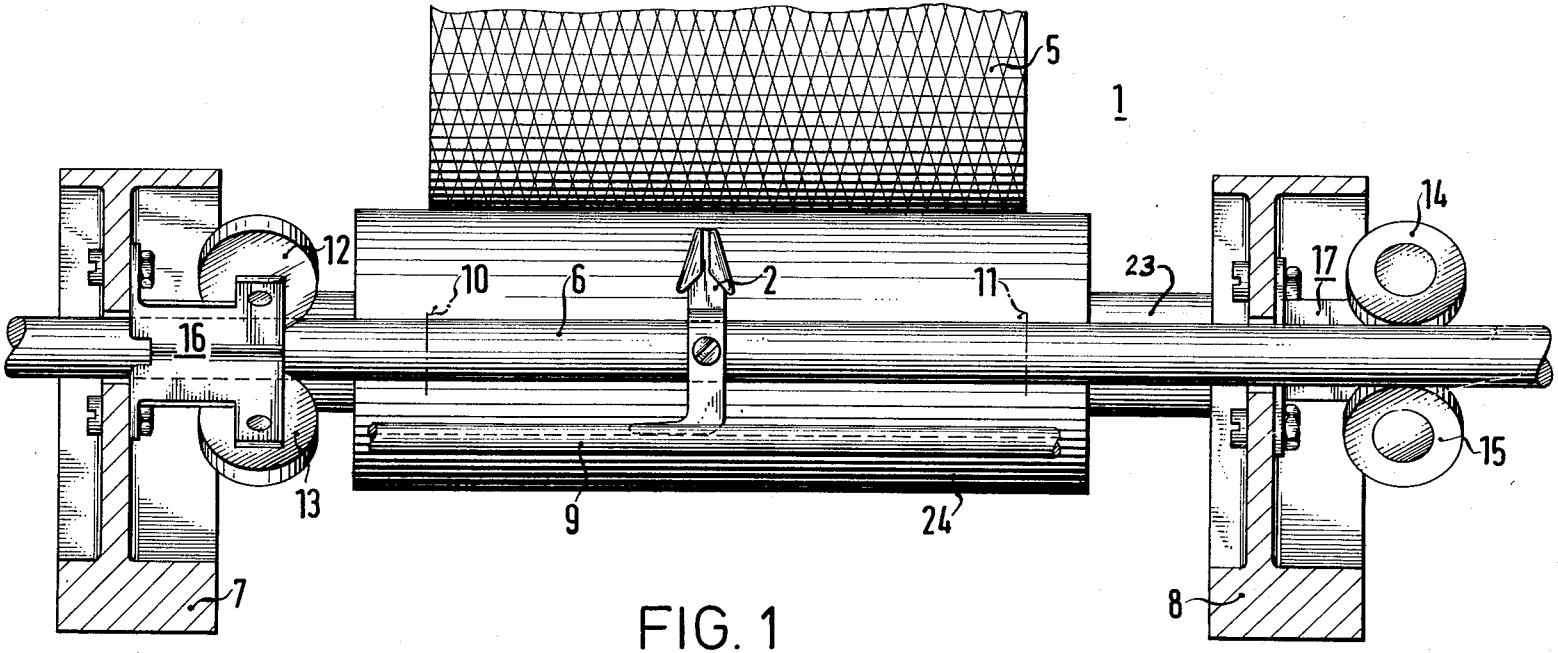
FIG. 1 is a fragmentary, diagrammatic, side-elevational view of a reciprocating rod and a thread guiding element of a machine producing cross-wound bobbins or cheeses.
Figure 2:
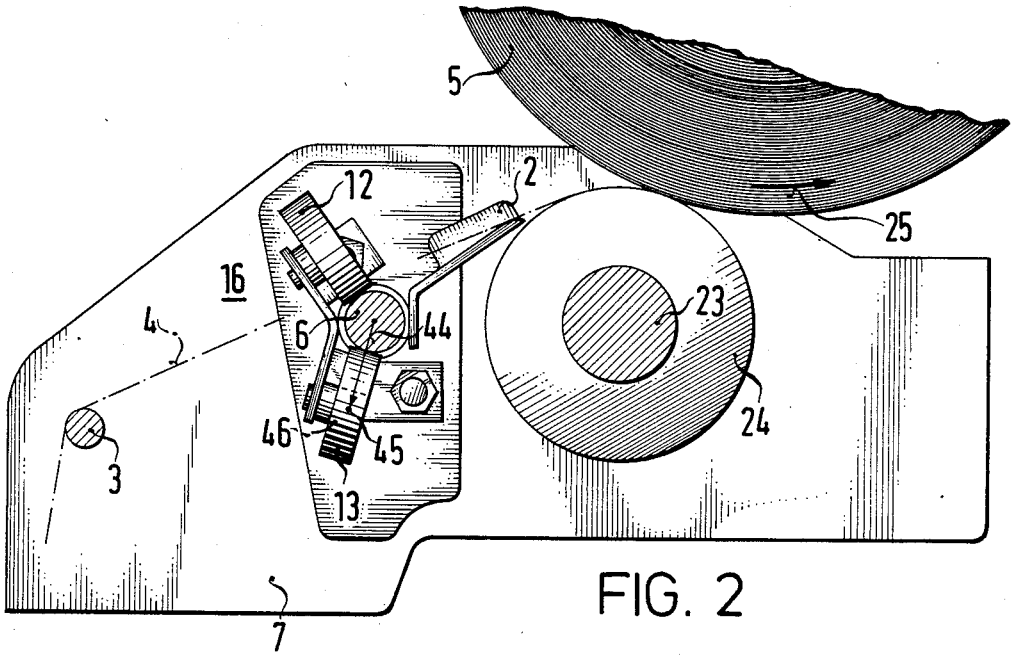
FIGS. 2 and 3 are fragmentary, front-elevational views of roller guiding elements in conjunction with the reciprocating rod.
Figure 3:
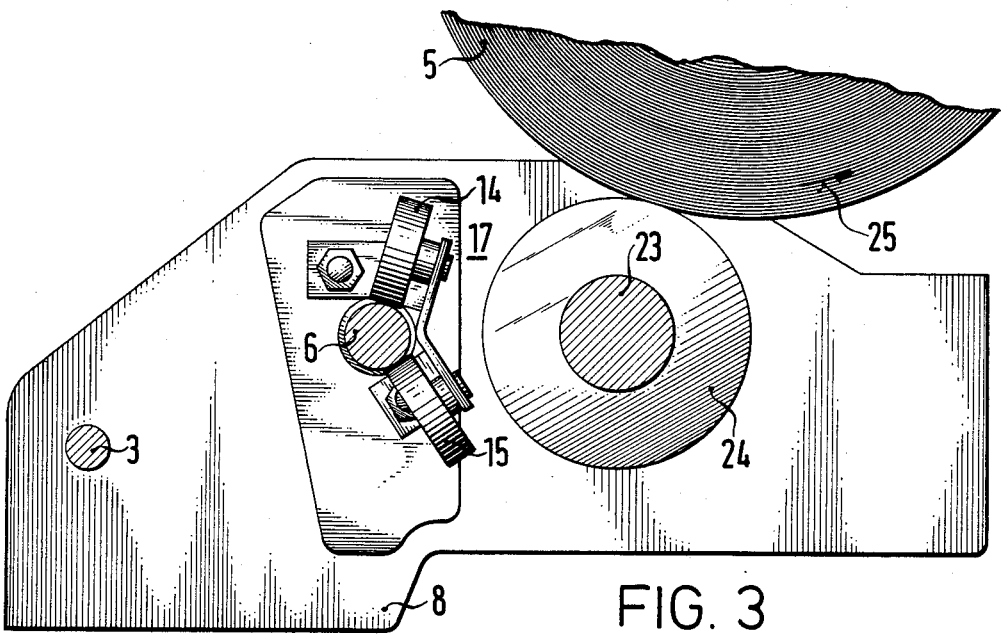

Referring now to the figures of the drawings in detail and first particularly to FIGS. 1–3 thereof, there is seen a machine for producing cross-wound bobbins or cheeses which is designated as a whole with reference numeral 1. The bobbin producing machine 1 is provided with a number of thread guiding elements 2 operating in parallel for guiding a thread 4 which is conducted to a cross-wound bobbin 5 over a guide rod 3 and is wound onto the bobbin. All of the thread guiding elements 2 of the machine 1 for producing crosswound bobbins are fastened to a reciprocating lifter rod 6 which is disposed along the length of the bobbin producing machine. The reciprocating rod 6 is supported in a special manner at certain points along a machine frame 7, 8. FIG. 1 shows that the thread guiding element is guided in a grooved rail 9 in such a way that it cannot tilt forward or backward. In order to guide the thread, the thread guiding element must continuously shuttle from a left end position 10 to a right end position 11, and back again. This is accomplished by the reciprocating rod 6.

Figure 4:
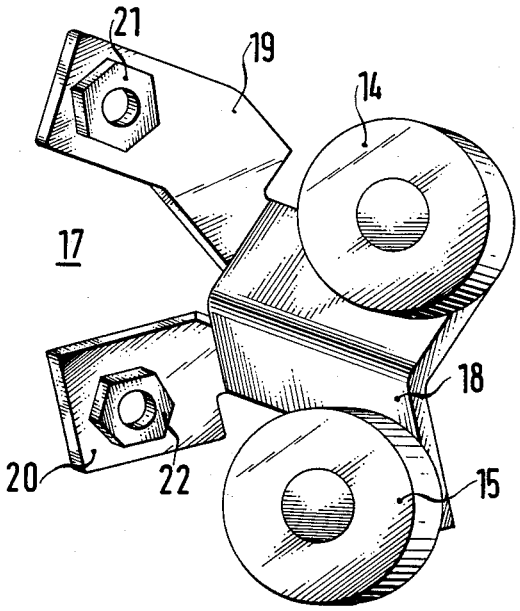
FIG. 4 is a perspective view of two roller guiding elements combined to form an element pair.

The reciprocating rod 6 is guided by detachable rotary or cylindrical guiding elements 12, 13, 14, 15, and is held in position by these guiding elements. These guiding elements are constructed as support rollers with ball bearings. Each two sets of roller guiding elements 12, 13 and 14, 15, respectively, are combined to form an element pair 16, 17, respectively, which is detachable, and can be mounted against the outside of the reciprocating rod 6. In FIG. 4 the element pair 17 is shown separately in a perspective view. An angled base plate 18 carries the two support rollers 14 and 15, both of which have a cylindrical outer surface. The base plate 18 is angled through approximately 120°, so that the two support rollers 14 and 15 bear against the reciprocating rod 6 at an angle of about 120°.

FIG. 4 shows that two lugs 19 and 20 are bent at a right angle from the base plate 18. Threaded nuts 21, 22, respectively, are each welded to one of the two lugs.

The element pair 17 is identical in appearance to the element pair 16. FIGS. 1 to 3 show how the two guiding element or roller pairs are fastened to the machine frame 7, 8 with screws. While FIG. 2 shows that the guiding element or roller pair 16 contacts the reciprocating rod 6 from the front of the rod as seen in FIG. 1, FIG. 3 shows that the other element pair 17 contacts the reciprocating rod 6 from the back of the rod as seen in FIG. 1. The abovedescribed manner of supporting the relatively thin and light weight reciprocating rod, which also can be made in the form of a tube, loads the rod from opposite sides, so that during the displacement of the load positions, a slightly elastic contact between the reciprocating rod and the roller-guiding elements is always maintained.

During operation, the cross-wound bobbin 5 rolls on a winding roller 24, which is driven by a shaft 23. The bobbin 5 is driven and rotated by the winding roller 24 in the direction of the curved arrow 25. The reciprocating rod 6 shuttles back and forth in the horizontal direction.

Figure 6:
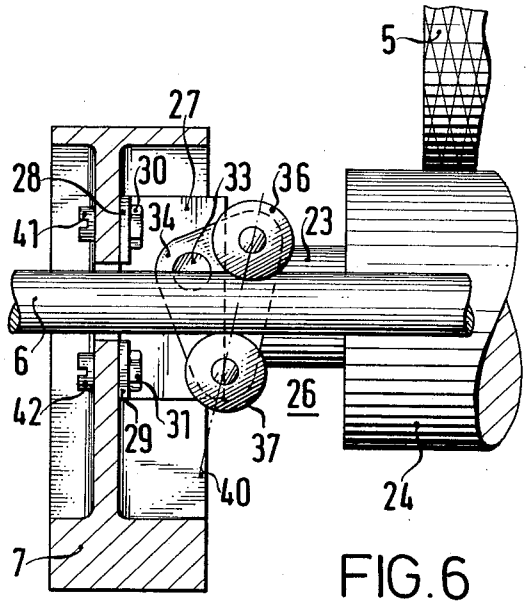
FIG. 6 is a fragmentary, side-elevational view of the device shown in FIG. 5.
Figure 5:
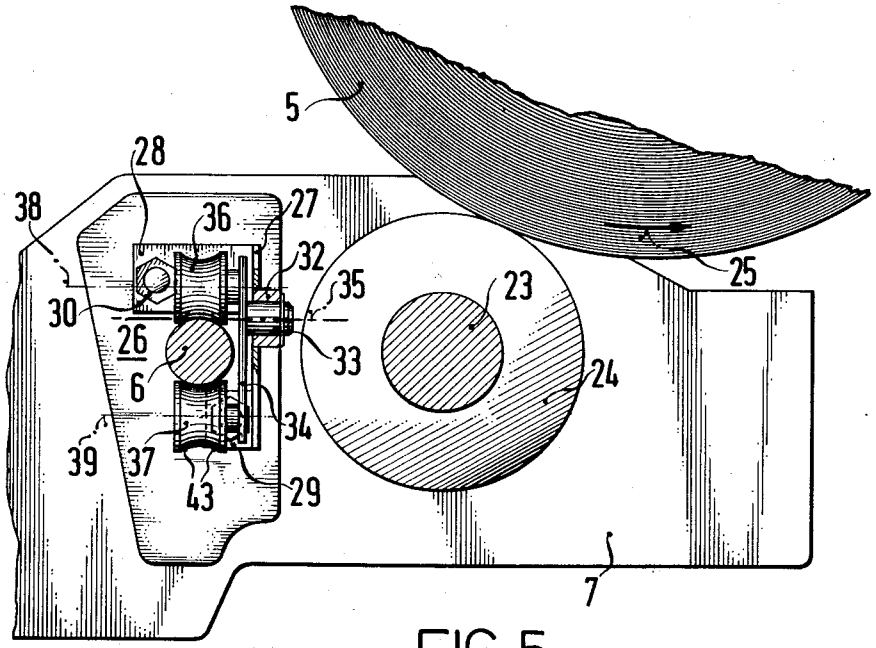
FIG. 5 is a view similar to FIGS. 2 and 3 showing the disposition of two tracking rollers combined to form an element pair for guiding the reciprocating rod.

A great number of guiding element or roller pairs 16, 17, respectively, are disposed along the length of the bobbin producing machine. Several differently constructed element pairs are also provided between the guiding element pairs like the pairs 16, 17, as illustrated in FIGS. 5 and 6. An element pair 26 shown in FIGS. 5 and 6 has a base plate 27, with two lugs 28, 29 which are bent at a right angle. A threaded nut 30, 31, respectively, is welded to each lug. These nuts serve for fastening the base plate 27 to the machine frame 7 with screws. The base plate 27 carries a bearing 32 for the pivot pin 33 of a supporting rocker 34. The rocker 34 can freely pivot around a horizontal pivot axis 35. The element pair 26 has two rolling guiding elements constructed in the form of ball bearing supported tracking or guiding rollers 36 and 37. FIGS. 5 and 6 show that the pivot pin 33 and the pivot axis 35 are disposed outside a plane 40 which is formed by the axes of rotation 38 and 39 of the tracking rollers 36 and 37, respectively. The distance between the two tracking rollers is somewhat greater than the diameter of the reciprocating rod 6. This has the advantage of permitting the element pair 26 to be detached from the reciprocating rod 6, if necessary, without disassembling the reciprocating rod itself, by removing the screws 41 and 42.

During operation, the reciprocating rod 6 bears against the tracking roller 37. This causes the rocker 34 to pivot clockwise in FIG. 6 until the tracking roller 36 contacts the reciprocating rod 6. Both tracking rollers are in constant contact with the reciprocating rod 6. The sides or surfaces of the tracking rollers 36 and 37 are tangent to the reciprocating shaft 6, so that there are two points in contact with the reciprocating rod for each tracking roller.

The invention is not limited to the illustrated and described embodiments which are used as examples. For instance, it is advantageous in order to avoid unnecessary wear, to place the support roller 13 at the machine frame 7 in such a way that the sum of the normal forces 44, which are exerted by the reciprocating rod 6 onto the support roller 13 transversely to the longitudinal axis of the rod, pass through the center point 45 of the support roller bearing 46, as indicated by an arrow in FIG. 2 at the support roller 13. Normal forces directed transversely to the longitudinal axis of the rod mainly result from the pressure caused by the elastic behavior of the rod and the pulling force of the threads.

The conditions explained above with respect to the support roller 13, also apply for the other support rollers.

I claim:

1. Machine for producing cross-wound bobbins, comprising a machine frame, detachable rotary guiding elements supported at fixed locations on said machine frame, a reciprocating rod guided by said rotary guiding elements, said rotary guiding elements being distributed along the length of and about the periphery of said rod, and a plurality of thread guiding elements operating in parallel and being driven in common by said rod, two of said rotary guiding elements being combined into a common element pair mountable against the outside of said rod, said rotary guiding elements of said element pair being rollers having axes of rotation defining a plane, said rollers being spaced apart by a distance somewhat greater than the diameter of said rod, and said element pair including a supporting rocker carrying said rollers and being freely pivotable about a horizontal axis disposed outside said plane.

2. Machine according to claim 1, wherein said rollers support said rod.

3. Machine according to claim 1, wherein each of said rotary guiding elements contacts said rod at least at one support point and at most at two support points along said rod.

4. Machine according to claim 2, wherein said support rollers have bearings with center points, and the sum of the normal forces exerted by said rod on one of said support rollers transverse to the longitudinal axis of said rod, passes through said center point of said bearing of said one roller.

5. Machine according to claim 2, wherein said rotary guiding elements alternately contact said rod from opposite sides thereof.

6. Machine according to claim 1, wherein said rod has an outer surface with a portion facing said machine frame and another portion facing away from said machine frame, and said supporting rocker being disposed at one of said portions of said outer surface of said rod.

7. Machine according to claim 1, wherein said supporting rocker is disposed between said rod and said machine frame.

* * * * *